United States Patent [19]

Sweatman et al.

[11] Patent Number: 4,569,394

[45] Date of Patent: Feb. 11, 1986

[54] METHOD AND APPARATUS FOR INCREASING THE CONCENTRATION OF PROPPANT IN WELL STIMULATION TECHNIQUES

[75] Inventors: Ronald E. Sweatman, Cypress, Tex.; Earl R. Freeman, Oklahoma City, Okla.; John Gottschling, Williamstown, W. Va.

[73] Assignee: Hughes Tool Company, Houston, Tex.

[21] Appl. No.: 584,584

[22] Filed: Feb. 29, 1984

[51] Int. Cl.[4] ..... E21B 43/267

[52] U.S. Cl. ..... 166/280; 166/79; 166/177; 166/308; 166/309; 166/75.1

[58] Field of Search ..... 166/75 R, 79, 91, 177, 166/259, 271, 280, 308, 309; 175/71, 72

[56] References Cited

U.S. PATENT DOCUMENTS

| | | | |
|---|---|---|---|
| 3,090,439 | 5/1963 | Copland et al. | 166/75 R |
| 3,136,361 | 6/1964 | Marx | 166/308 |
| 3,396,107 | 8/1968 | Hill | 166/308 X |
| 3,603,398 | 9/1971 | Hutchison et al. | 166/305 R |
| 3,980,136 | 9/1976 | Plummer et al. | 166/280 |
| 4,003,432 | 1/1977 | Paull et al. | 166/280 X |
| 4,126,181 | 11/1978 | Black | 166/75 R X |
| 4,156,464 | 5/1979 | Hussin | 166/308 |
| 4,354,552 | 10/1982 | Zingg | 166/91 X |
| 4,453,596 | 6/1984 | Conway et al. | 166/308 X |
| 4,460,045 | 7/1984 | Elson et al. | 166/309 X |
| 4,512,405 | 4/1985 | Sweatman et al. | 166/278 |

OTHER PUBLICATIONS

Randall et al., "Stearates, Foaming Agents Combat Water in Air or Gas Drilling", *The Oil and Gas Journal*, Nov. 3, 1958, pp. 78–83.

Smith, *The Oil and Gas Journal*, vol. 57, No. 44, Oct. 26, 1959, pp. 83–86.

*Primary Examiner*—George A. Suchfield

*Attorney, Agent, or Firm*—Robert A. Felsman; Charles D. Gunter, Jr.

[57] ABSTRACT

A method and apparatus are shown for treating a subsurface earth formation penetrated by a well bore. A proppant is blended with a foamable carrier to form a slurry and the slurry is pressurized to a desired pressure. A gas is added to the pressurized slurry to form a foam. Proppant is then added pneumatically to the pressurized slurry after foaming the slurry and the pressurized fluid is injected into the well bore. The proppant is fed to a manifold which is connected to a source of pressurized gas whereby the application of gas pressure to the manifold serves to blow the proppant into the pressurized foam stream. The foam containing the proppant is then injected into the well in the conventional manner to prop open the fracture.

13 Claims, 5 Drawing Figures

METHOD AND APPARATUS FOR INCREASING THE CONCENTRATION OF PROPPANT IN WELL STIMULATION TECHNIQUES

CROSS-REFERENCE TO RELATED APPLICATIONS

The present invention is related to the field of the invention disclosed and claimed in copending U.S. patent application Ser. No. 584,581, now U.S. Pat. No. 4,512,405, entitled "Pneumatic Transfer of Solids Into Wells" filed concurrently herewith.

BACKGROUND OF THE INVENTION

The present invention relates generally to a method and apparatus for treating a subsurface earth formation penetrated by a well bore and, specifically, to a method and apparatus for pneumatically adding additional proppant to a pressurized fluid being injected into a well bore to stimulate a well.

Various methods are known for stimulating the production of crude oil and natural gas from wells drilled in reservoirs of low permeability. Certain prior art techniques have involved the hydraulic fracturing of such formations with various liquids such as crude oil, with or without proppants such as sand, glass beads, or the like. Hydraulic pressure was applied to the permeable formation to fracture the rock surrounding the well bore. The initially formed fractures were then extended by the injection of fluids containing a proppant to be deposited in the fractures. The hydraulic pressure was then released and the proppant which was deposited in the fractures served to hold the fractures open so that channels were created for flow of reservoir fluids to the well annulus. It has been recognized for some time that the concentration of proppant in the stimulation fluid is significant since it determines the final thickness of the fractures.

Another prior art technique for stimulating reservoirs of low permeability is the use of hydraulic fracturing with foam. Typical foam fracturing operations involve making a foam by blending sand with a jelled water solution and treating the solution thus formed with a surfactant. The fluid pressure is increased with a conventional pump after which a gas, such as nitrogen, is injected into the fluid to create a high pressure foam. The foam containing the sand proppant is then injected into the well. Foam fracturing has several advantages over fracturing techniques using conventional liquids. Foam has a low fluid loss and has the ability to create larger area fractures with equivalent volumes of treatment fluid. Since fluid loss to the formation is minimized, the chances of damaging sensitive formations is lessened. The foam is also thought to have a higher sand carrying and sand suspending capability to suspend a greater amount of sand in the foam until the fracture starts to heal. Since the foam has a high effective viscosity, sand does not settle out of the carrier fluid as quickly as it would settle from a traditional fluid such as crude oil. The foam creates wider vertical fractures as well as horizontal fractures of greater area.

In spite of the many advantages of using foam, some of which have been described, one disadvantage of such prior art techniques is that the maximum concentration of proppant obtainable is quite low. Conventional hydraulic fluids can achieve sand concentrations of 6 to 8 lbs. per gallon of carrying fluid. However, with foamed fluids, the gas expands the liquid to about four times the original volume of the gelled liquid. The net result is that the sand foam concentration is reduced to about $1\frac{1}{2}$ to 2 lbs. per gallon of carrying fluid.

In order to provide a foam fracturing fluid that was a high concentration of sand or other proppant, various schemes have been suggested which involve introducing the pressurized foamable fluid and sand slurry into a centrifugal separator or concentrator for separating some of the carrier fluid to concentrate the amount of proppant per volume of carrier fluid. The equipment necessary to effect such a separation is expensive and the separated fluid is usually wasted. Such schemes have generally been effective only to increase the proppant concentration from about 6 to 8 lbs. per gallon of carrying fluid to about 12 to 15 lbs. per gallon of carrying fluid. This results in a sand concentration of about 3 to 4 lbs. of proppant per gallon of carrying foam.

There exists a need, therefore, for a method and apparatus for treating a subsurface earth formation with pressurized foam which allows an increased proppant concentration to provide a greater fracture thickness.

There exists a need for such a method and apparatus which is simple in design and operation and which does not add greatly in the overall cost of the fracturing job.

There exists a need for such a method and apparatus which provides a proppant concentration in the foam carrier in excess of 4 lbs. per gallon of proppant carrier foam.

There exists a need for such a method and apparatus which provides a proppant concentration in a fluid in excess of 6 to 8 lbs. per gallon of carrying fluid without the wasted fluid and expense of separators or concentrators.

There exists a need for such a method and apparatus which reduces or eliminates the need for abrasive proppant passing thru and wearing very expensive conventional sand/fluid blending and high pressure pump equipment, and which reduces or eliminates the use of conventional sand/fluid blending and high pressure pump equipment.

SUMMARY OF THE INVENTION

In the method of treating a subsurface earth formation of the invention, a proppant is blended with a foamable carrier to form a carrier slurry. The slurry is then pressurized and a pressurized gas is added to the slurry to form a pressurized foam. Additional proppant is then added pneumatically by using a bypass or secondary flow of gas pressure to blow proppant into the main pressurized gas flow to increase the proppant concentration in the pressurized foam. The pressurized foam is then injected into the well bore.

Preferably, the additional proppant is fed to a manifold which is connected to a source of pressurized gas whereby the application of gas to the manifold serves to blow the additional proppant into the pressurized foam. The proppant can be supplied from tube truck proppant containers connected to the manifold. A source of gas pressure is connected by an inlet line to one side of the manifold and an outlet line is connected to the opposite side of the manifold for receiving a flow of pressurized gas and entrained proppant exiting the manifold. A coupling connects the manifold outlet line to a conduit carrying the carrier fluid to the well.

The proppant containers are preferably cylindrical tubes having loading ends for receiving a quantity of proppant and discharge ends for dispensing proppant to a common manifold. The proppant containers can be mounted on the bed of a truck for transportation to the well site. A pivoting mechanism on the truck bed can be provided for inclining the longitudinal axis of the cylindrical proppant container with respect to the horizontal plane of the truck bed whereby proppant is supplied from the containers discharge ends to the common manifold by gravity feed.

An alternative or enhancement to gravity feed is to force proppant out of the tubes by gas flow into one end of the tubes thru a common inlet manifold and the proppant and gas mixture out of the opposite end of the tubes into a common discharge manifold. The common inlet manifold may be mounted on the opposite end of the tubes from the discharge manifold and may be used for loading proppant into the tubes. The inlet manifold may also be placed at any point between the ends of the tubes when enhancing gravity feed. Each tube may also have a valve to control the discharge rate.

Additional objects, feature and advantages will be apparent in the written description which follows.

DETAILED DESCRIPTION OF THE INVENTION

Figure 1:
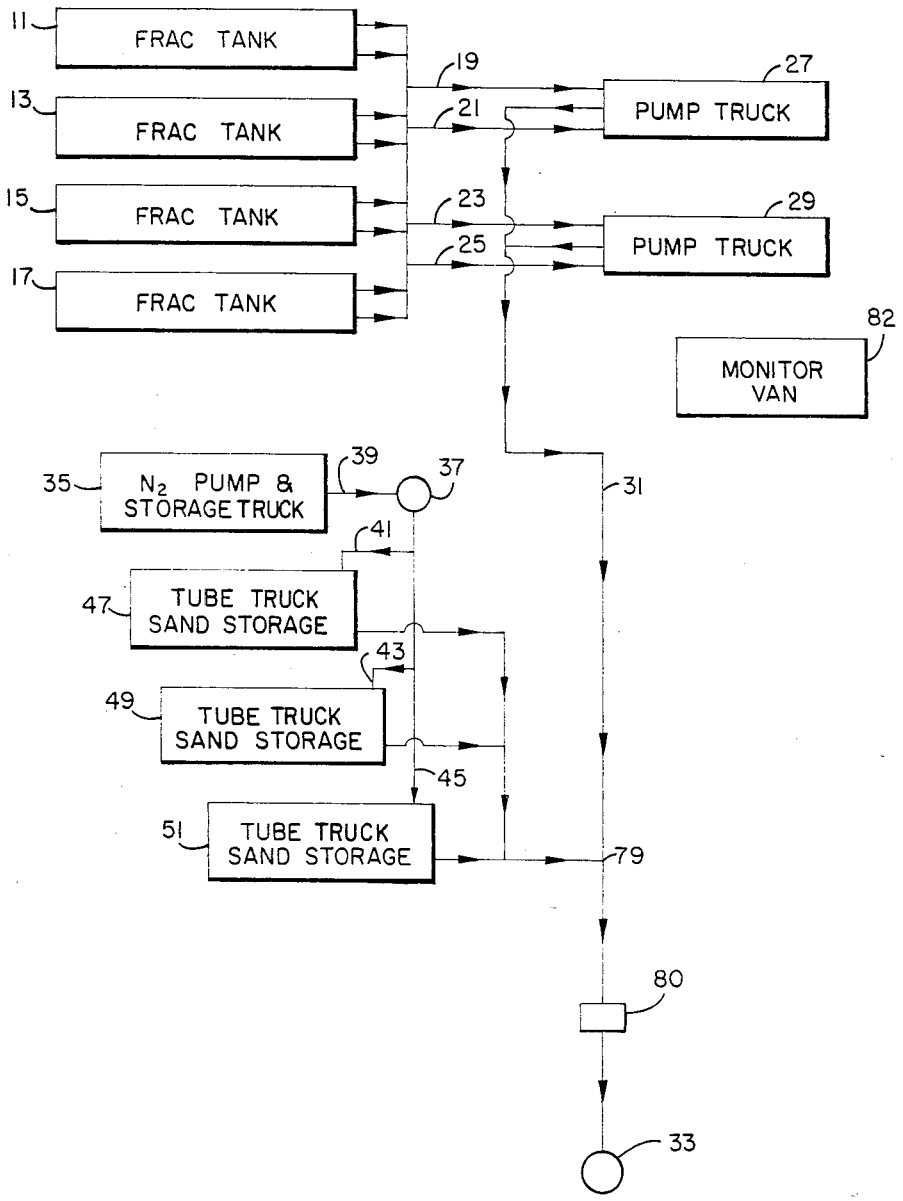
FIG. 1 is a schematic diagram of the process of the invention showing the pneumatic addition of proppant to a liquid, gelled carrier fluid.

FIG. 1 is a schematic diagram illustrating one form of the present method of treating a subsurface earth formation penetrated by a well bore. As shown in FIG. 1, one or more fracturing tanks or tank trucks 11, 13, 15, and 17 store a fluid carrier which can be a liquid, a gel, a colloidal suspension, or the like. The term "carrier fluid" or "fluid carrier" is meant to include ungelled water, hydrocarbon liquids, acids and liquified gases such as carbon dioxide. In the preferred embodiment, the carrier can comprise water thickened with a guar gum at a concentration in the range of about 1 to 5 lbs. per 100 gallons of water. The water-guar gum solution forms a gel, the viscosity of which depends on the rate of shear. The gel is a non-neutonian fluid with a plastic viscosity in the range from about 10 to 30 centipoise. The carrier fluid passes out conduits 19, 21, 23, 25 to one or more high pressure injection pumps, preferably located on pump trucks 27, 29. The pump trucks 27, 29 are conventional equipment used to raise the pressure of the carrier liquid to at least the required wellhead pressure, usually less than about 5000 psig. The gelled water slurry flows out a connecting fluid conduit 31 to the well head 33.

A nitrogen storage tank and pump 35 are provided for adding a pressurized gas to the gelled water slurry in the conduit 31. A low rate meter 37, such as a differential orifice meter, is provided in the line 39 from the nitrogen pump 35 to provide a flow rate in the range of about 400 to 2500 SCF/MIN of nitrogen. The low rate nitrogen flow passes through one or more inlet lines 41, 43 and 45 to the sand truck tube manifolds 47, 49 and 51. It should be understood that while three tube trucks are illustrated in FIG. 1, that a greater or lesser number can be utilized depending on the size of the job. The use of a plurality of tube trucks allows one truck to be taken off line and refilled while another truck is connected to the source of pressurized gas.

Figure 4:
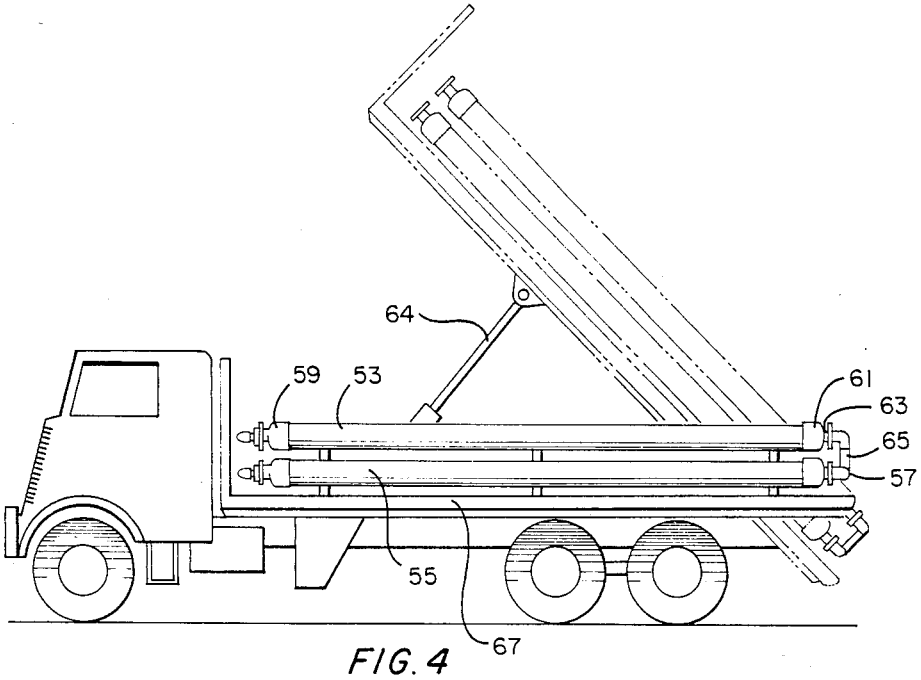
FIG. 4 is a side perspective view of a truck for transporting the proppant containers used in practicing the method of the present invention.
Figure 5:
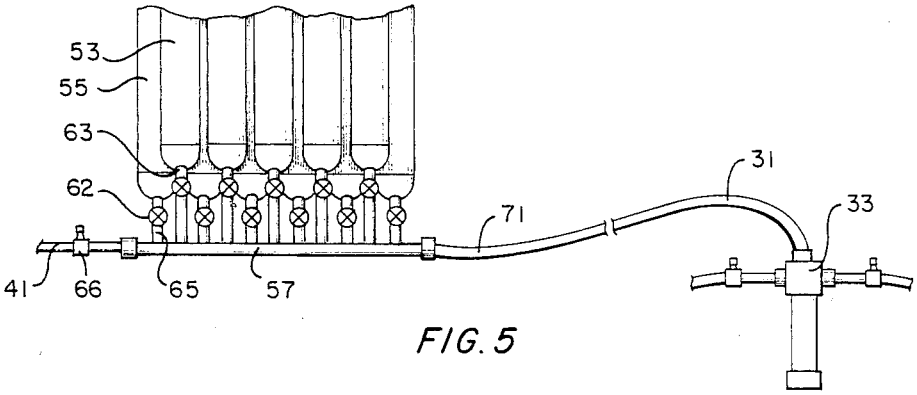
FIG. 5 is a partial close-up perspective view of the proppant containers and manifold used in practicing the method of the invention.

The tube truck, proppant containers, and manifold used in the method of the invention are shown in greater detail in FIGS. 4 and 5. The tube truck includes one or more proppant containers 53, 55 which are connected to a common manifold 57 for receiving a gradual flow of particulate proppant from the containers 53, 55. The preferred proppant is 40 to 60 screen sand. However, other proppants can be used including glass, plastics, or metal particles. The proppant containers 53, 55 are preferably generally cylindrical tubes having closed ends. Each tube has a loading end or cap 59 for receiving a quantity of proppant from a holding tank or bin (not shown) and a discharge cap or end 61 for dispensing proppant to the common manifold 57. The discharge pipes 63 extending from the discharge caps 61 of the tubes 53 are connected, as by a T-connection 65 into the manifold 57. Flow valves 62 can be provided for controlling the flow of proppant from the discharge ends 61.

The tube design allows for lower cost construction than heavy wall relatively short height or length pressure vessel designs with inside length to inside diameter ratios of less than about 5 to 1. Preferably the tubes used for the proppant containers 53, 55 have ratios in the range from about 5 to 1 to upwards of 500 to 1. The tubes 53, 55 are mounted by any convenient means on a pivoting bed 67 of a transport truck 69 whereby the longitudinal axis of the proppant carrier tubes 53 can be pivoted with respect to the bed 67 of the truck to allow the proppant in the containers 53, 55 to flow by gravity feed to the manifold 57. A hydraulic lift 64 pivots the truck bed 67 between a horizontal position and selected vertically inclined angles (shown in dotted lines in FIG. 4). An alternative pneumatic force feed through the tubes can enhance the gravity feed method when well conditions require very high proppant discharge rates or where conditions require the tubes to discharge proppant with the tubes in the horizontal position.

The nitrogen inlet line 41 is connected to one end of the manifold 57 for supplying gas pressure through a valve 66 to the manifold and the manifold has an outlet line 71 which is connected through a T-connection 79 (FIG. 1) to the fluid conduit 31. T-connection 79 can be placed on the wellhead 33 when required by job design. By adding the proppant pneumatically to the pressurized slurry in the fluid conduit 31, a gelled fluid and sand slurry can be provided with 1 to 2% nitrogen by volume and sand concentrations of up to about 16 lbs. per gallon of carrier slurry. A nuclear densimeter 80 can be provided in the fluid conduit 31 for monitoring the sand rate going to the wellhead 33. The monitor van 82 also contains conventional monitoring equipment for checking pressure sensors at various points in the fluid conduits and monitoring the volume of sand passing into the well with time.

In the method of FIG. 1, sand is added downstream pneumatically to the gelled fluid after the high pressure pumps, thus lessening pump wear. The sand is added to the fluid conduit 31 in a low rate nitrogen flow carrying a high rate of sand. Liquefied gases such as carbon dioxide can be used in the method of FIG. 1 when fracturing water sensitive formations.

Figure 2:
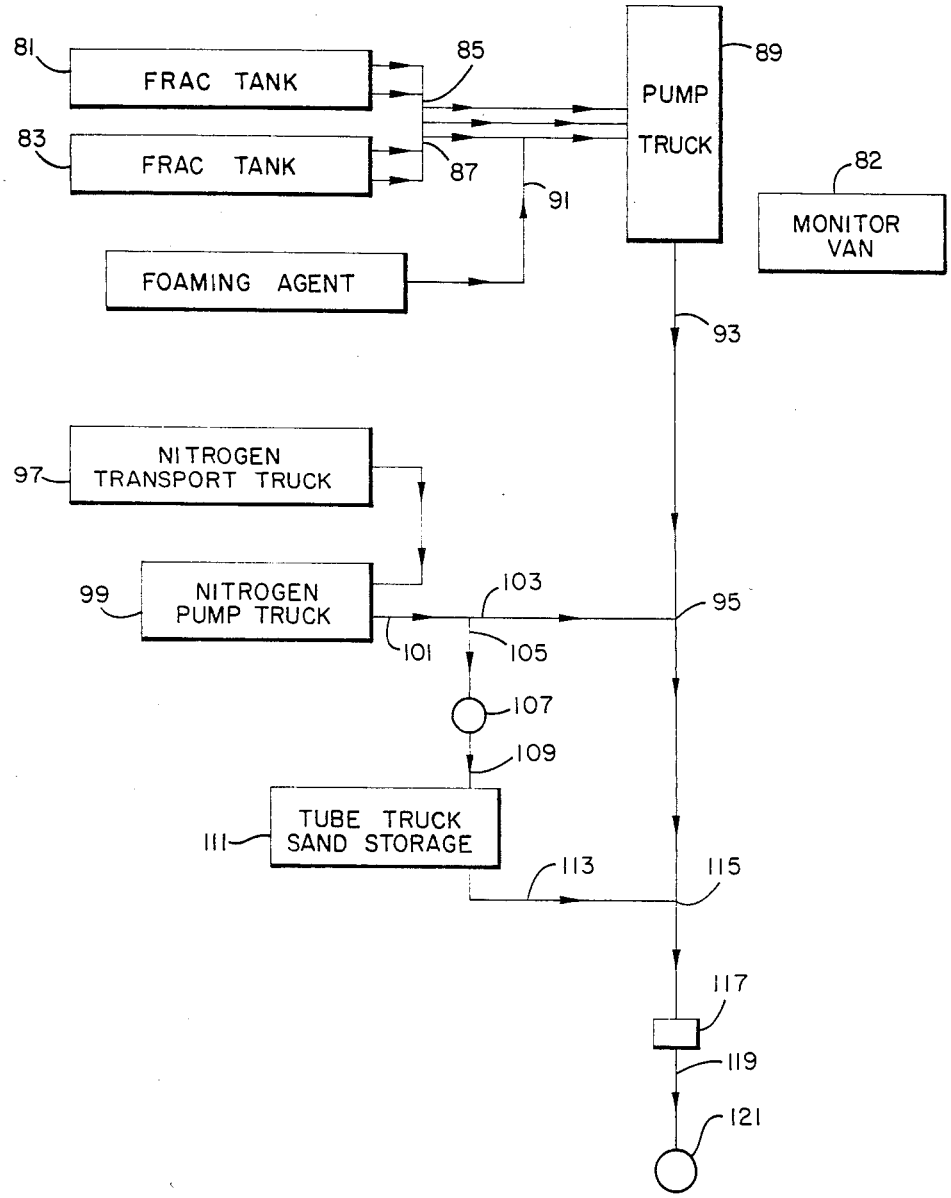
FIG. 2 is a schematic diagram of another process of the invention for adding proppant to a foam carrier with all of the proppant being added after formation of the foam carrier.

FIG. 2 illustrates another embodiment of the method of the invention. Once again, fracturing tanks 81, 83 provide a water-gel slurry through outlet conduits 85, 87 to a high pressure pump 89. A foaming agent, such as a conventional surfactant, is supplied through an inlet line 91 to the water-gel slurry on the way to the pump truck 89. The gelled slurry and surfactant pass out a fluid conduit 93 toward a foam generation tee 95. Nitrogen is supplied from a transport truck 97 to a nitrogen pump truck 99 and passes out an outlet line 101 where the fluid flow splits between a high rate nitrogen line 103 carrying nitrogen at a rate in the range of about 10,000 to 50,000 SCF/min. and a low rate line 105. A low rate meter 107 in the low rate line 105 provides a nitrogen flow rate in the range of about 400 to 2500 SCF/MIN through the fluid line 109 leading to the manifold on the sand tube truck 111.

The low rate nitrogen passes through the tube truck manifold and pneumatically blows sand being fed from the proppant containers 53 into the manifold 57 out the outlet line 113 to a connecting tee 115 on the fluid conduit 93.

The resulting foam contains sand in a concentration up to about 16 pounds per gallon of foam. The foam passes through a nuclear densimeter 117 and through a fluid conduit 119 to the wellhead 121 as previously described.

The method shown in FIG. 2 adds nitrogen at a high rate through the high rate line 103 to form foam in the fluid conduit 93 prior to the addition of sand in the low rate stream passing through outlet line 113 to the connecting tee 115. Conventional sand/water blender trucks and sand storage tanks are not needed in this method where tube trucks are used to pneumatically add sand to the foam. Once again, the sand is being added downstream of the high pressure pump to save wear on the pump.

Figure 3:
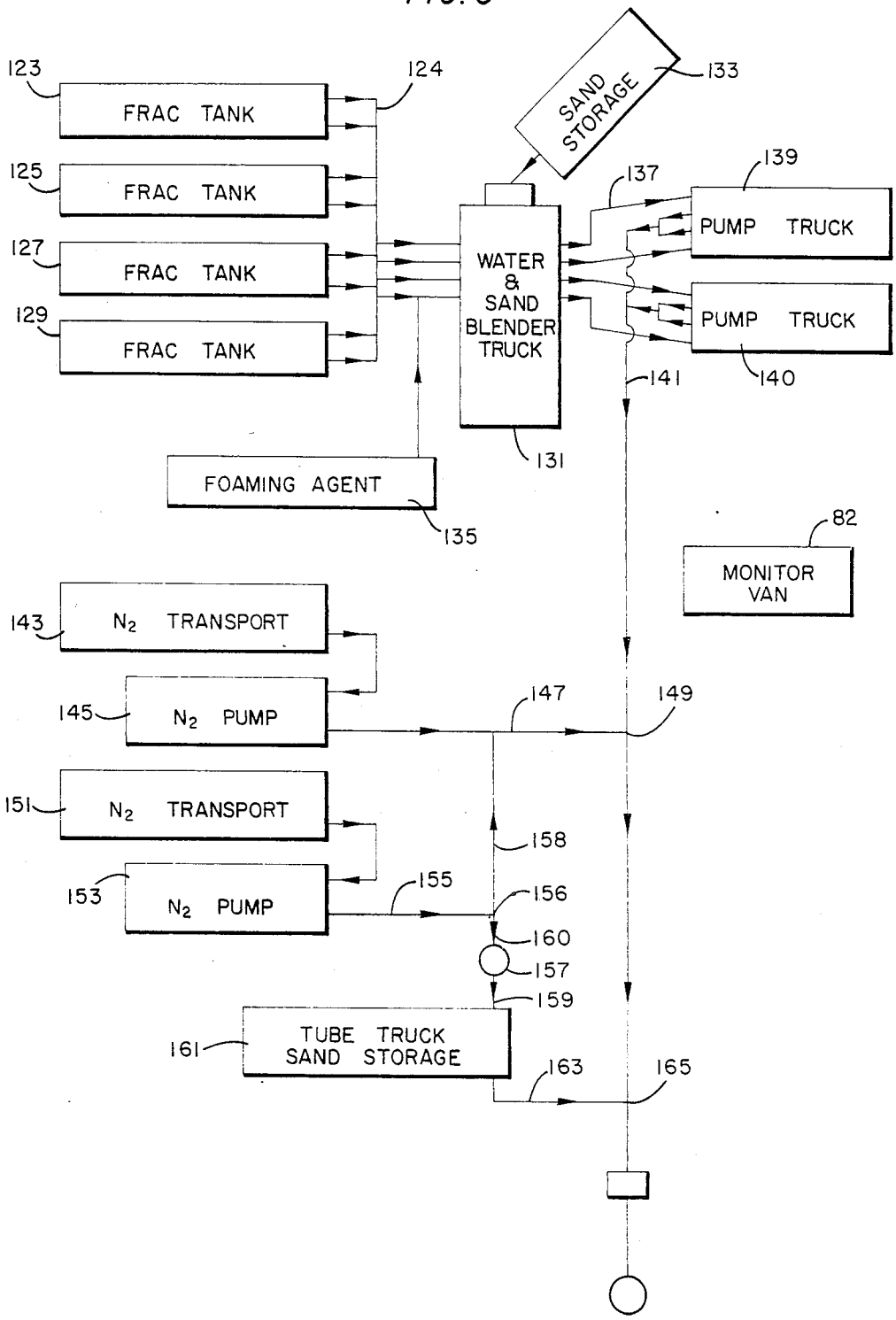
FIG. 3 is a schematic diagram of another process of the invention for adding additional proppant to a conventional proppant carrying foam being injected into a well.

FIG. 3 shows another embodiment of the invention in which fracturing tanks 123, 125, 127, 129 supply a water-gel carrier fluid through outlet lines, e.g. line 124, to a water and sand blender truck 131. The conventional water and sand blender truck 131 is connected to a sand storage tank 133 and a foaming agent, such as a surfactant can be supplied from a tank 135 to the outlet lines 137 from the blender 131 to the pump truck pumps 139, 140. The outlet lines, e.g. line 137, from the water and sand blender 131 pass to one or more high pressure pumps 139, 140 to provide a pressurized gel-water slurry containing sand in a concentration of about 6 to 8 lbs. per gallon in the fluid conduit 141.

Nitrogen from a nitrogen transport 143 is supplied to a nitrogen pump 145. High rate nitrogen passes through a gas line 147 and fluid tee 149 to the fluid conduit 141 to form a foam containing sand in a concentration of about $1\frac{1}{2}$ to 2 lbs. per gallon of foam. Another nitrogen transport 151 supplies nitrogen to a nitrogen pump 153 which is connected by a gas line 155 to a gas tee 156. High rate nitrogen flows through line 158 back into line 147. The remainder of the nitrogen flow from line 155 passes down line 160 to a low rate meter 157 which supplies low rate nitrogen, i.e., 400–2500 SCF/min., through an inlet line 159 to the tube truck manifold 161. The tube truck outlet line 163 is connected by a fluid tee 165 to conduit 141 whereby sand is pneumatically added to the foam in conduit 141. In this way, sand concentrations upwards of 16 pounds per gallon of carrying foam can be achieved.

An invention has been provided with significant advantages. The present method allows foamed carriers to contain proppant concentrations upwards of 16 pounds per gallon of carrier without the use of expensive centrifugal separation schemes or complicated equipment. The increased proppant concentrations can be added downstream of the high pressure pumps to lessen pump wear.

While the invention has been shown in only three of its forms, it is not thus limited but is susceptible to various changes and modifications without departing from the spirit thereof.

We claim:

1. A method of treating a subsurface earth formation penetrated by a well bore, comprising the steps of:

blending a proppant with a foamable carrier, thereby forming a slurry;

pressurizing the slurry to a desired pressure;

adding a pressurized gas to the slurry to form a pressurized foam;

pneumatically adding additional proppant to the pressurized foam to thereby increase the proppant concentration in the pressurized foam;

injecting the pressurized foam into the well bore.

2. The method of claim 1 wherein the additional proppant is fed to a manifold which is connected to a source of pressurized gas, whereby the application of gas pressure to the manifold serves to blow the additional proppant into the pressurized foam.

3. A method of treating a subsurface earth formation penetrated by a well bore, comprising the steps of:

preparing a foamable carrier;

pressurizing the carrier to a desired pressure;

adding a pressurized gas to the carrier to form a pressurized foam and pumping the pressurized foam through a conduit toward the well bore;

pneumatically adding proppant to the pressurized foam traveling through the conduit prior to reaching the well bore; and injecting the pressurized foam containing the proppant into the well bore.

4. The method of claim 3, wherein the concentration of proppant in the pressurized foam being injected into the well bore is in the range of about $\frac{1}{4}$ to 16 pounds of proppant per gallon of foam.

5. The method of claim 3, wherein the proppant is fed to a manifold which is connected by an inlet line to a source of pressurized gas and by an outlet line to the conduit containing the pressurized foam whereby the application of gas pressure to the manifold causes proppant to become entrained in the gas flow to blow the additional proppant into the pressurized foam.

6. A method of treating a subsurface earth formation penetrated by a well bore, comprising the steps of:

preparing a liquid carrier;

pressurizing the carrier to a desired pressure;

adding a pressurized gas carrying an entrained proppant to the carrier to form a pressurized fluid containing a proppant, the gas volume to liquid carrier volume ratio being less than 3 to 1; and injecting the pressurized fluid into the well bore.

7. The method of claim 6, wherein the concentration of proppant in the pressurized fluid being injected into the well bore is in the range of about ¼ to 16 pounds of proppant per gallon of fluid.

8. An apparatus for injecting proppant into a conduit containing a carrier of the type used to treat a subsurface earth formation penetrated by a well bore, comprising:

a plurality of cylindrical proppant containers having a loading end for receiving a quantity of proppant and a discharge end for dispensing proppant to a common manifold;

a manifold connected to said proppant containers for receiving a gradual flow of particulate proppant from said containers;

a source of gas pressure connected by an inlet line to one side of said manifold;

an outlet line connected to the opposite side of said manifold for receiving a flow of pressurized gas and entrained proppant exiting said manifold; and coupling means for connecting said outlet line to the conduit containing said carrier.

9. The apparatus of claim 8, wherein said plurality of cylindrical proppant containers are mounted on the bed of a truck for transportation to the well site.

10. The apparatus of claim 9, further comprising a source of pneumatic pressure communicated to said proppant containers for forcing proppant from said discharge ends.

11. The apparatus of claim 10, wherein said cylindrical proppant containers have a length to diameter ratio in the range from about 5:1 to about 500:1.

12. The apparatus of claim 9, further comprising:

pivoting means on said truck bed for inclining the longitudinal axis of said cylindrical proppant containers with respect to the horizontal plane of said truck bed whereby proppant is supplied from said container discharge ends to said common manifold by gravity feed.

13. The apparatus of claim 12, further comprising a source of pneumatic pressure communicated to said proppant containers for enhancing the gravity feed of said proppant from said discharge ends.

* * * * *